US008739570B2

(12) United States Patent
Prestwidge

(10) Patent No.: US 8,739,570 B2
(45) Date of Patent: Jun. 3, 2014

(54) EYEGLASS HOLDER

(76) Inventor: Karen Prestwidge, Teaneck, NJ (US)

( * ) Notice: Subject to any disclaimer, the term of this patent is extended or adjusted under 35 U.S.C. 154(b) by 39 days.

(21) Appl. No.: 13/439,921

(22) Filed: Apr. 5, 2012

(65) Prior Publication Data

US 2012/0255326 A1 Oct. 11, 2012

Related U.S. Application Data

(60) Provisional application No. 61/516,645, filed on Apr. 6, 2011.

(51) Int. Cl.
*A44C 15/00* (2006.01)

(52) U.S. Cl.
USPC ..... 63/1.12; 224/251; 248/693; 248/902; 24/3.3; 351/157

(58) Field of Classification Search
None
See application file for complete search history.

(56) References Cited

U.S. PATENT DOCUMENTS

| | | | | |
|---|---|---|---|---|
| 4,674,298 | A * | 6/1987 | Wimmershoff-Caplan | 24/3.13 |
| 4,894,887 | A | 1/1990 | Ward, II | |
| 5,305,934 | A | 4/1994 | Grey | |
| 5,893,198 | A | 4/1999 | DeCotis | |
| 6,293,128 | B1 * | 9/2001 | Leufray-Simms | 63/23 |

* cited by examiner

*Primary Examiner* — Jack W. Lavinder
(74) *Attorney, Agent, or Firm* — Klauber & Jackson LLC

(57) ABSTRACT

A device or holder for holding a pair of eyeglasses that may be incorporated into a necklace assembly is provided. The holder or device may be connected to a necklace having a first and a second end by a linker, one linker attached to the holder and adapted to attach to a first end of a necklace and one linker attached to the holder and adapted to attach to a second end of a necklace. The first and second end of the necklace may have terminal loops. The necklace assembly may be worn about the neck having a device or holder for holding a temple piece of eyeglasses assembly connected between ends of the necklace. The device or holder for holding a temple piece of eyeglasses includes an eyeglass-holder tube and optionally a first and a second linker.

15 Claims, 5 Drawing Sheets

EYEGLASS HOLDER

FIELD OF THE INVENTION

The present invention provides a device or holder for a pair of eyeglasses. The device or holder suited to accept and hold a pair of eyeglasses may be joined to a necklace assembly for holding eyeglasses and that may be worn about the neck.

BACKGROUND

Individuals wearing eyeglasses may wish to remove and replace them multiple times during the course of a day. After removing eyeglasses from the face, it is desirable to keep the eyeglasses nearby to be able to locate and replace them easily. Many eyeglass wearers often place the eyeglasses in a shirt or coat pocket or hang the eyeglasses from an opening of a shirt, sweater, jacket or blouse by inserting a temple piece inside the shirt, sweater, jacket or blouse. However, the eyeglasses may fall from such a position upon bending over. This is dangerous for both damaging and losing the eyeglasses.

Ward, U.S. Pat. No. 4,894,887 teaches an eyeglass carrier clip that may be clipped to a pocket for supporting a pair of eyeglasses by one of its temple pieces. The eyeglass carrier clip requires that the user wear a garment having a pocket suitable for clipping the device.

Grey, U.S. Pat. No. 5,305,934 teaches a tool and eyeglass holder that may be hung from the neck for holding eyeglasses and a screwdriver and spare screws for repairing the eyeglasses. The holders include a flexible cord or other elongated flexible member each end of which is either directly attached to a loop element or formed into a loop. The loops are respectively connected to corresponding loops at the ends of a tool container for the screwdriver and screws by interlocking the respective loops. A loop element is extended below the tool container for holding a pair of eyeglasses by inserting a temple piece of the eyeglasses through an aperture defined by the loop. Because of the interlocked loops connecting the flexible member to the tool container, the tool and eyeglass holder must be slipped over the head of the user in order to be hung about the neck.

De Cotis, U.S. Pat. No. 5,893,198 teaches a necklace assembly for holding a pair of eyeglasses that features an elongated flexible necklace for wearing about the neck and an eyeglass-holder assembly connected between the first and second ends of the necklace. The eyeglass-holder assembly includes an eyeglass-holder loop having a receiver loop opening adapted to receive a temple piece of a pair of eyeglasses. The assembly further features a first and second swivel linker connected to the necklace and to the holder-loop so that the necklace and the holder loop are rotatably joined. Further, the assembly features a necklace/holder-assembly coupler connecting the first end of the necklace with the swivel linker and a second necklace/holder-assembly coupler connecting the second end of the necklace with the swivel linker. The assembly may be worn about the neck with a pair of eyeglasses in a folded-closed configuration held in the eyeglass-holder loop of the eyeglass-holder assembly with a temple piece extending downwardly from one side of the temple-piece-receiver loop opening and a lens frame of the eyeglasses extending downwardly from an opposite side of the loop opening and with twisting induced in the necklace by movement of the wearer tending to be relieved by rotation of the swivel linkers. The receiver loop is a circle and it is free to rotate with respect to the necklace.

It is desirable to provide an eyeglass holder designed to more securely hold a temple piece of eyeglasses. Further, it is desirable to provide an eyeglass holder and linker designed for substantially fixed attachment to a necklace that does not rotate substantially with respect to the necklace. Still further, it is desirable to provide an eyeglass holder that may be made of artistic and attractive beads providing a stylish alternative to eyeglass holders presently available.

SUMMARY OF THE INVENTION

The present invention provides a device or holder for holding a pair of eyeglasses securely that may be incorporated into a necklace assembly. In some embodiments, the holder or device for holding a pair of eyeglasses may be connected to a necklace having a first and a second end by a linker, one linker attached to the holder and adapted to attach to a first end of a necklace and one linker attached to the holder and adapted to attach to a second end of a necklace. The first and second end of the necklace may have a first and a second terminal loop.

In other embodiments, the holder or device for holding a pair of eyeglasses may be connected to a necklace having a first and a second end directly, that is, without a linker. Such a direct connection between the holder or device for holding a pair of eyeglasses and the necklace may be provided with, for instance, a crimp tube.

In still other embodiments, holder or device for holding a pair of eyeglasses may be connected to or engaged with a necklace in a substantial clasp. Such an attachment or engagement may substantially place the holder or device for holding a pair of eyeglasses on a side of a wearer's chest. Optionally, such an attachment or engagement may provide a wearer the option of moving the holder or device for holding a pair of eyeglasses relative to the wearer's body, such as, for instance to the back of the neck when not in use. An attachment or engagement in such embodiments may feature a necklace attached to or in engagement with a holder or device for holding a pair of eyeglasses in such a manner so that the holder or device for holding a pair of eyeglasses is less prominent relative to the necklace or less noticeable relative to the necklace. In such embodiments, the necklace or the first and second end of the necklace may be threaded through the tube portion of the holder or device for holding a pair of eyeglasses from both the top and the bottom thereof substantially along the same line and secured either on opposite sides or looped through again and secured on the same side of the tube portion of the holder or device for holding a pair of eyeglasses.

The necklace assembly of the invention may comprise an elongated flexible necklace for wearing about the neck and a device or holder for holding a temple piece of eyeglasses assembly connected between first and second ends of the necklace. The device or holder for holding a temple piece of eyeglasses includes an eyeglass-holder tube and a first and a second linker. The eyeglass-holder tube of the device or holder for holding a temple piece of eyeglasses has a temple-piece-receiver tube opening which is shaped and sized to receive a temple piece of a pair of eyeglasses. Each linker of the device or holder for holding a temple piece of eyeglasses has a necklace-side connector and a side designed to connect to the device or holder for holding a temple piece of eyeglasses. Each linker may be substantially fixed to the device or holder for holding a temple piece of eyeglasses so as to substantially prevent or inhibit rotation of the linker with respect to the device or holder for holding a temple piece of eyeglasses. A first and second terminal loop of the necklace may be provided on the first end of the necklace and the second end of the necklace so as to provide connection between the linkers and the first and second ends of the necklace.

The necklace assembly of the invention may be worn about the neck of a wearer with a pair of eyeglasses in a folded, substantially closed configuration removable and pendulously held in the device or holder for holding a temple piece of eyeglasses assembly with a temple piece extending downwardly from one side of the device or holder for holding a temple piece of eyeglasses opening and a lens frame of the eyeglasses extending downwardly from an opposite side of the device or holder for holding a temple piece of eyeglasses opening. The necklace assembly of the invention operated to retain the eyeglasses securely in the device or holder for holding a temple piece of eyeglasses of the assembly as the wearer moves about or bends over. Advantageously, twisting or kinking of the necklace of the necklace assembly of the invention induced by movement of the wearer is minimized so that the necklace assembly tends to lie substantially flatly and neatly on the chest of the wearer when the wearer stands or sits upright.

Preferably, the eyeglass holder device of the device or holder for holding a temple piece of eyeglasses of the necklace assembly is substantially in the shape of a tube. The substantially tube shaped eyeglass holder device preferably has a diameter in the range of from about 0.4 to 1.3 inches, with a diameter of about 0.5 inches being particularly preferred. Preferably, the necklace of the invention is an ornamental jewelry chain.

BRIEF DESCRIPTION OF THE DRAWINGS

Preferred embodiments of the device or holder for holding a temple piece of eyeglasses and the necklace assembly of the invention are described below with reference to the following figures.

DETAILED DESCRIPTION OF THE PREFERRED EMBODIMENTS

Figure 1:
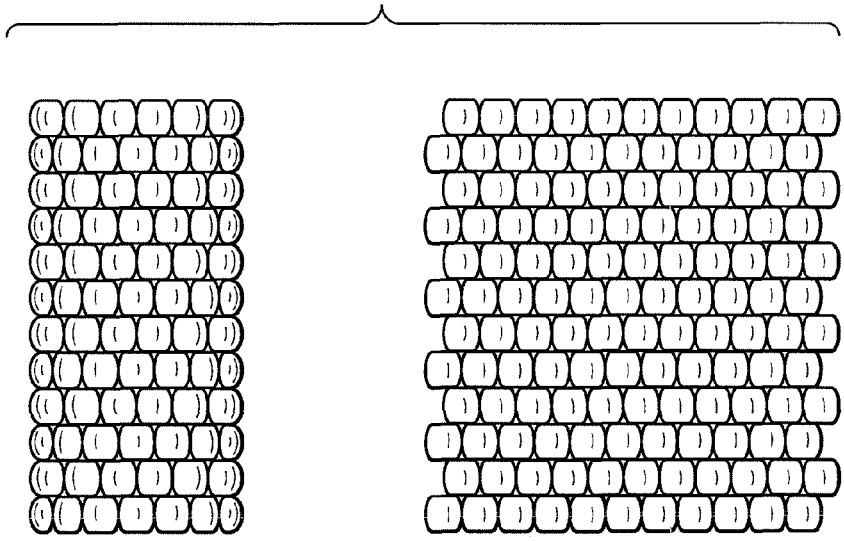
FIG. 1 is a front view of a device or holder for holding a temple piece of eyeglasses.

Turning to FIG. 1, a device or holder for holding a temple piece of eyeglasses 1 is provided with a tube in a substantially cylindrical form that may be elongated in shape and having an opening at each end, and opening at a first end 2, and an opening at a second end 3. The eyeglass holder device may be formed of any material amenable to being formed into a sheet and connected together into a substantially cylindrical form.

Figure 2:
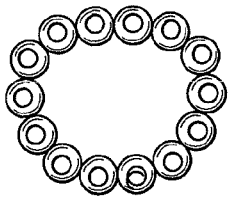
FIG. 2 is a top or bottom view of a device or holder for holding a temple piece of eyeglasses.

FIG. 2 provides a top or a bottom view of the device or holder for holding a temple piece of eyeglasses 1 in a substantially cylindrical form that may be elongated in shape and having an opening at each end, and opening at a first end 2, and an opening at a second end 3.

Figure 3:
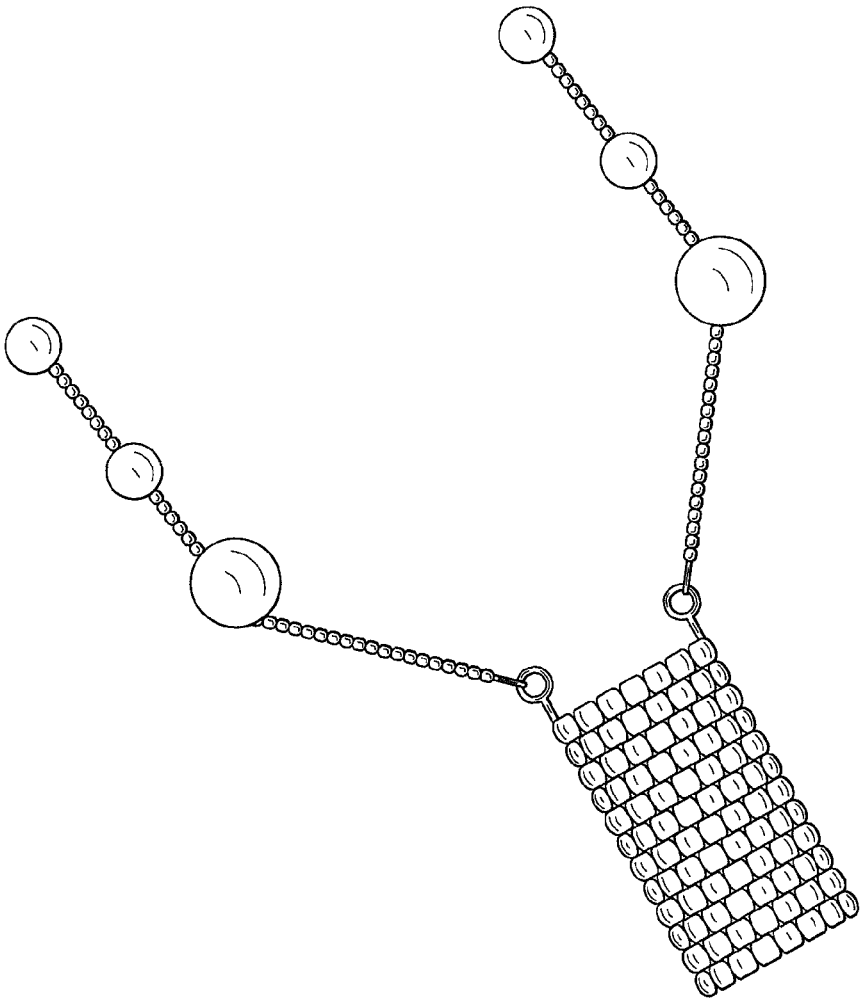
FIG. 3 is a necklace assembly having a device or holder for holding a temple piece of eyeglasses linked by two fixed linkers, one linker linking the device or holder for holding a temple piece of eyeglasses to a first end of a necklace and a second linker linking the device or holder for holding a temple piece of eyeglasses to a second end of a necklace so that the device or holder for holding a temple piece of eyeglasses, two linkers and necklace together form a necklace assembly.

FIG. 3 illustrates a necklace assembly 5 having a device or holder for holding a temple piece of eyeglasses 1 attached to or in engagement with a first end of a necklace 6 and a second end of a necklace 7 so that the device or holder for holding a temple piece of eyeglasses 1 and necklace 8 together form a necklace assembly 5.

A necklace assembly 5 for holding a pair of eyeglasses includes a relatively elongated necklace 8. The necklace 8 may be a simple cord, or it may be an ornamental jewelry chain having beads, crystals and the like attached thereto or entwined therein. For example, a jewelry chain necklace 8 may be a jewelry chain made of gold, silver or other precious metal or of a mock-tortoise-shell or mock-ivory plastic material. At opposite ends of the necklace 8 may be a first necklace terminal loop 9 and a second necklace terminal loop 10.

A device or holder for holding a temple piece of eyeglasses 1 is connected to the two terminal loops 9 and 10 of the necklace 8. The eyeglass-holder assembly then includes a device or holder for holding a temple piece of eyeglasses.

Figure 4:
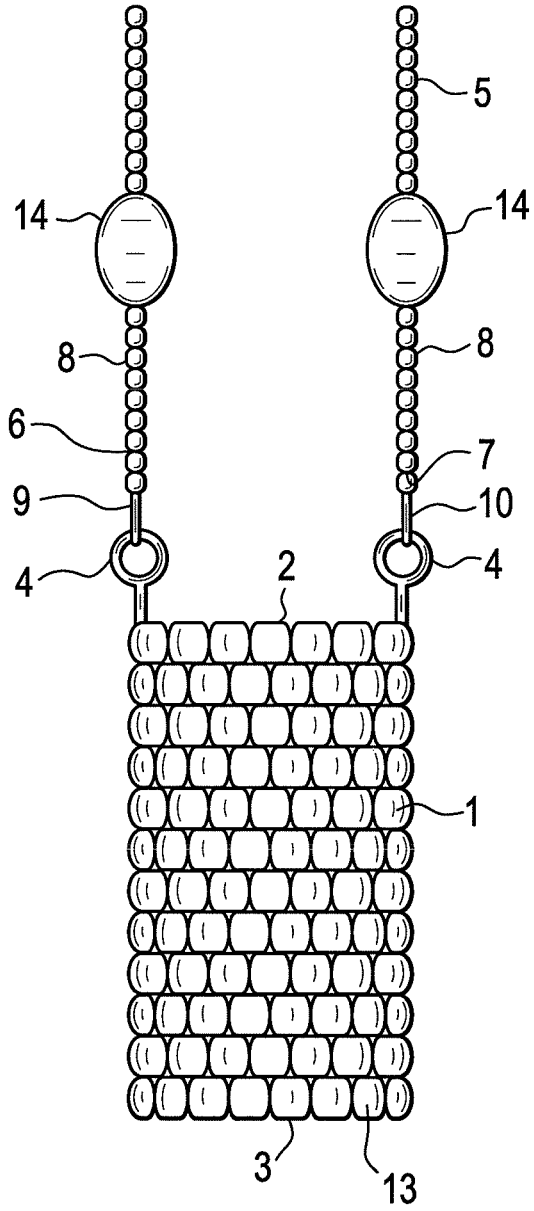
FIG. 4 is another view of a necklace assembly having a device or holder for holding a temple piece of eyeglasses linked by two fixed linkers, one linker linking the device or holder for holding a temple piece of eyeglasses to a first end of a necklace and a second linker linking the device or holder for holding a temple piece of eyeglasses to a second end of a necklace so that the device or holder for holding a temple piece of eyeglasses, two linkers and necklace together form a necklace assembly.

FIG. 4 depicts a necklace assembly 5 having a device or holder for holding a temple piece of eyeglasses 1 linked by two fixed linkers 4, one linker linking a device or holder for holding a temple piece of eyeglasses to a first end of a necklace 6 and a second linker linking the eyeglass holder device to a second end of a necklace 7 so that the device or holder for holding a temple piece of eyeglasses 1, two linkers 4 and necklace 8 together form a necklace assembly 5.

A necklace assembly 5 for holding a pair of eyeglasses includes a relatively elongated necklace 8. The necklace 8 may be a simple cord, or it may be an ornamental jewelry chain having beads, crystals and the like attached thereto or entwined therein. For example, a jewelry chain necklace 8 may be a jewelry chain made of gold, silver or other precious metal or of a mock-tortoise-shell or mock-ivory plastic material. At opposite ends of the necklace 8 may be a first necklace terminal loop 9 and a second necklace terminal loop 10.

A device or holder for holding a temple piece of eyeglasses 1 is connected to the two terminal loops 9 and 10 of the necklace 8. The eyeglass-holder assembly then includes a device or holder for holding a temple piece of eyeglasses, a first linker and a second linker 4. The two linkers 4 may be constructed identically. The linkers 4 include a necklace connector ring 11 and the eyeglass holder device connector such as a ring 12. The necklace connector ring 11 and the eyeglass holder device connector such as a ring 12 of the linker 4 are normally designed so as not to permit rotation about an axis. As may be seen in FIG. 4, the terminal loops of the necklace 9 and 10 pass through the linkers 4.

Figure 5:
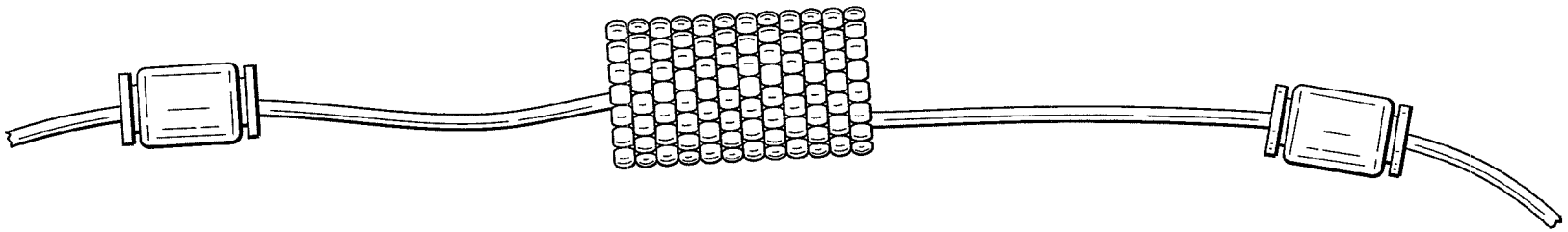
FIG. 5 is a necklace assembly having a device or holder for holding a temple piece of eyeglasses in a clasp effect attachment with the necklace that places the device or holder for holding a temple piece of eyeglasses on the side of the wearer's chest and optionally provides the wearer the option of moving the device or holder for holding a temple piece of eyeglasses relative to the wearer's body. The ends of the necklace are threaded through the device or holder for holding a temple piece of eyeglasses from both the top and the bottom along the same line and secured either on the opposite sides or looped through again and secured on the same side.

FIG. 5 illustrates a necklace assembly 5 having a device or holder for holding a temple piece of eyeglasses 1 attached to or in engagement with a necklace 8 so that the device or holder for holding a temple piece of eyeglasses 1 and necklace 8 together form a necklace assembly 5. A necklace assembly 5 for holding a pair of eyeglasses includes a relatively elongated necklace 8. A device or holder for holding a temple piece of eyeglasses 1 is connected to or in engagement with the necklace 8 by means of the necklace 8 passing through a first end 2 and a second end 3 of the device or holder for holding a temple piece of eyeglasses 1. Alternatively, the necklace 8 may pass through a side or wall of the device or holder for holding a temple piece of eyeglasses 1 or may be connected to, sewn to, or otherwise engaged with the device or holder for holding a temple piece of eyeglasses 1.

Figure 6:
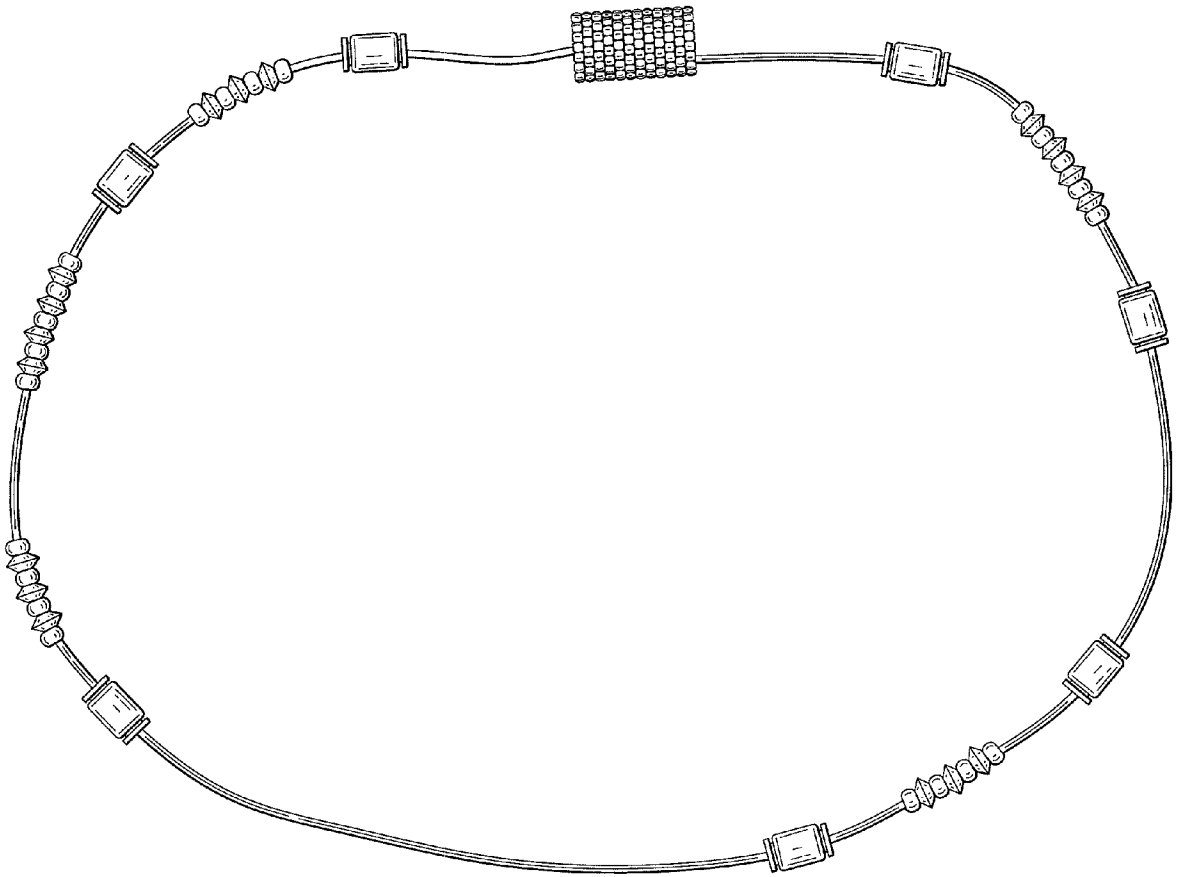
FIG. 6 is another view of a necklace assembly having a device or holder for holding a temple piece of eyeglasses in a clasp effect attachment with the necklace that places the device or holder for holding a temple piece of eyeglasses on the side of the wearer's chest and optionally provides the wearer the option of moving the device or holder for holding a temple piece of eyeglasses relative to the wearer's body. The ends of the necklace are threaded through the device or holder for holding a temple piece of eyeglasses from both the top and the bottom along the same line and secured either on the opposite sides or looped through again and secured on the same side.

Also, as may be seen in FIG. 6, as with FIG. 5, a necklace assembly 5 having a device or holder for holding a temple piece of eyeglasses 1 attached to or in engagement with a necklace 8 so that the device or holder for holding a temple piece of eyeglasses 1 and necklace 8 together form a necklace assembly 5. A necklace assembly 5 for holding a pair of eyeglasses includes a relatively elongated necklace 8. A device or holder for holding a temple piece of eyeglasses 1 is connected to or in engagement with the necklace 8 by means of the necklace 8 passing through a first end 2 and a second end 3 of the device or holder for holding a temple piece of eyeglasses 1. Alternatively, the necklace 8 may pass through a side or wall of the device or holder for holding a temple piece of eyeglasses 1 or may be connected to, sewn to, or otherwise engaged with the device or holder for holding a temple piece of eyeglasses 1.

A central opening 13, defined by a top end and a bottom end, 2 and 3 of the device or holder for holding a temple piece of eyeglasses 1 of the necklace assembly 5 defines an opening for receiving a temple piece of eyeglasses. The temple piece of the eyeglasses may be inserted into the central opening 13 via the top end 2 or the bottom end 3, so that the eyeglasses may be held in a folded closed configuration that is held substantially in place by the device or holder for holding a temple piece of eyeglasses 1. As a result, the eyeglasses remain in place in a pendulous position on the chest or abdomen of the wearer.

The device or holder for holding a temple piece of eyeglasses provides a substantial sleeve or tube attached to a chain through which a temporal piece of eyeglasses may be placed and secured. The device or holder for holding a temple piece of eyeglasses may be formed or any suitable material such as, for instance, fabric, plastic, rubber or seed beads such as #8 seed beads. The eyeglass holder device may be, for instance, made from opalescent clear beads with an upper and lower border of opalescent silver or opalescent gold beads. The eyeglass holder device made of such beads may be formed in, for instance, a 1.38"×1.13" peyote-stitched mat, using, for instance, a 12×22 bead pattern. It may then be zipped closed to form a flexible tube of, for instance, 0.5" diameter tube, 1.13" in length. There are many suitable sizes, such as, for instance a 0.25-1.0" in tube diameter, 0.30-0.80" in tube diameter, 0.40-0.80" in tube diameter, or 0.50-0.75" in tube diameter. The eyeglass holder device may be, for instance at least about 0.25", 0.50", 0.75", 1.00", 1.10", 1.20", 1.25", 1.30", 1.40", 1.50", 1.75" or 2.0" or more in length.

It is not intended to limit the present invention to the specific embodiments described above. For example, the eyeglass-holder device of the eyeglass-holder assembly of the necklace assembly of the invention may be of any suitable shape or size or made of any suitable material. Jewelry chains or beads of any suitable size, shape or style 14 may be used for the necklace of the necklace assembly of the invention. It is recognized that these and other changes may be made in the necklace assembly of the invention specifically described herein without departing from the scope and teachings of the invention. The present invention is intended to encompass all embodiments, alternatives, and modifications consistent herewith.

I claim:

1. A necklace assembly for holding a pair of eyeglasses comprising:

(a) a necklace for wearing about the neck having a first end and a second end; and (b) a device or holder for holding a temple piece of eyeglasses comprising:

i) a flexible tube in a substantially cylindrical form having a first end and a second end wherein the cylindrical flexible tube is about 0.25" to 1.00" in length and is formed of stitched seed beads; and ii) two substantially fixed linkers, a first linker linking the device or holder for holding a temple piece of eyeglasses to the first end of the necklace and a second linker linking the eyeglass holder device to the second end of the necklace, wherein the two substantially fixed linkers do not permit substantial rotation about an axis of the flexible tube with respect to the necklace.

2. The necklace assembly of claim 1 wherein the necklace further comprises one or more terminal loops.

3. The necklace assembly of claim 1 wherein the two substantially fixed linkers comprise a necklace connector ring.

4. The necklace assembly of claim 1 wherein the flexible tube in a substantially cylindrical form having a first end and a second end is about 0.25" to 1.00" in diameter.

5. A device or holder for holding a temple piece of eyeglasses comprising:

i) a flexible tube in a substantially cylindrical form having a first end and a second end wherein the cylindrical tube is about 0.25" to 1.00" in length and is formed of stitched seed beads; and ii) two substantially fixed linkers, a first linker linking the device or holder for holding a temple piece of eyeglasses to the first end of the necklace and a second linker linking the eyeglass holder device to the second end of the necklace, wherein the two substantially fixed linkers do not permit substantial rotation about an axis of the flexible tube with respect to the necklace.

6. The device or holder for holding a temple piece of eyeglasses of claim 5 wherein the necklace further comprises one or more terminal loops.

7. The device or holder for holding a temple piece of eyeglasses of claim 5 wherein the two substantially fixed linkers comprise a necklace connector ring.

8. The device or holder for holding a temple piece of eyeglasses of claim 5 wherein the flexible tube in a substantially cylindrical form having a first end and a second end is about 0.25" to 1.00" in diameter.

9. A necklace assembly for holding a pair of eyeglasses comprising:

(a) a necklace for wearing about the neck having a first end and a second end; and (b) a device or holder for holding a temple piece of eyeglasses comprising a flexible tube in a substantially cylindrical form having a first end and a second end wherein the flexible cylindrical tube is about 0.25" to 1.00" in length and is formed of stitched seed beads.

10. The necklace assembly of claim 9 wherein the necklace further comprises one or more terminal loops.

11. The necklace assembly of claim 9 wherein the flexible tube in a substantially cylindrical form having a first end and a second end is about 0.25" to 1.00" in diameter.

12. A necklace assembly for holding a pair of eyeglasses comprising:

(a) a necklace for wearing about the neck having a first end and a second end; and (b) a device or holder for holding a temple piece of eyeglasses comprising a flexible tube in a substantially cylindrical form having a first end and a second end wherein the flexible cylindrical tube is about 0.25" to 1.00" in length and is formed of stitched seed beads, wherein the device is attached to or in substantial engagement with the necklace.

13. The necklace assembly of claim 12 wherein the necklace passes through the first end and the second end of the tube.

14. The necklace assembly of claim 12 wherein the necklace passes through a side of the tube or is attached to or in engagement with a side of the tube.

15. The necklace assembly of claim 12 wherein the flexible tube in a substantially cylindrical form having a first end and a second end is about 0.25" to 1.00" in diameter.

* * * * *